US012546529B2

(12) United States Patent
Kwon

(10) Patent No.: US 12,546,529 B2
(45) Date of Patent: Feb. 10, 2026

(54) REFRIGERATOR

(71) Applicant: LG ELECTRONICS INC., Seoul (KR)

(72) Inventor: Junyoung Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 71 days.

(21) Appl. No.: 18/583,505

(22) Filed: Feb. 21, 2024

(65) Prior Publication Data

US 2024/0353167 A1 Oct. 24, 2024

(30) Foreign Application Priority Data

Apr. 20, 2023 (KR) ..... 10-2023-0052319

(51) Int. Cl.
*F25D 23/02* (2006.01)

(52) U.S. Cl.
CPC ..... *F25D 23/028* (2013.01); *F25D 2700/02* (2013.01)

(58) Field of Classification Search
CPC ..... F25D 23/028; F25D 2700/02; E05F 3/10; E05F 3/108
See application file for complete search history.

(56) References Cited

U.S. PATENT DOCUMENTS

| | | | | |
|---|---|---|---|---|
| 10,260,795 | B2 | 4/2019 | Giacomini et al. | |
| 2016/0356541 | A1* | 12/2016 | Giacomini | F25D 29/008 |
| 2018/0274852 | A1* | 9/2018 | Kang | F25D 23/025 |

FOREIGN PATENT DOCUMENTS

| | | | | |
|---|---|---|---|---|
| CN | 101784854 | A | 7/2010 | |
| CN | 106837046 | A | 6/2017 | |
| CN | 216114942 | U * | 3/2022 | |
| EP | 3 401 625 | A1 | 11/2018 | |
| JP | 2006118858 | A * | 5/2006 | F25D 23/028 |
| WO | WO 2006/006707 | A1 | 1/2006 | |

* cited by examiner

*Primary Examiner* — Matthew W Ing
(74) *Attorney, Agent, or Firm* — Birch, Stewart, Kolasch & Birch, LLP

(57) ABSTRACT

A refrigerator includes a cabinet which has a storage space; a door which opens and closes the storage space; a detection device which is provided in the cabinet and detects the closing of the door; and a damping device which is provided on the door and reduces the closing speed of the door, in which the damping device is disposed at a position corresponding to the detection device and is in contact with the detection device when the door is closed.

18 Claims, 8 Drawing Sheets

(a)

(b)

REFRIGERATOR

CROSS-REFERENCE TO RELATED APPLICATIONS

The present application claims priority under 35 U.S.C. 119 to Korean Patent Application No. 10-2023-0052319, filed in the Republic of Korea on Apr. 20, 2023, which is hereby incorporated by reference in its entirety.

BACKGROUND

The present disclosure relates to a refrigerator.

In general, a refrigerator is a home appliance that allows food to be stored at low temperatures in an internal storage space shielded by a door. To this end, refrigerators are designed to keep stored food in optimal condition by cooling the inside of the storage space using cold air generated through heat exchange with the refrigerant circulating in the refrigeration cycle.

Recently, refrigerators are gradually becoming larger and more multi-functional in accordance with changes in eating habits and the trend of higher quality products, and refrigerators with various structures that take user convenience into consideration are being released.

When a device is provided to provide space for door storage of a refrigerator or to provide additional functions such as an ice maker or dispenser, the weight of the door increases. Additionally, when heavy materials such as glass or metal are used to enhance the outer appearance of the refrigerator door, the weight of the door increases even when a transparent panel assembly is provided so that the storage space of the door can be viewed from the outside. Additionally, even when a large amount of food is stored in the door or heavy food is stored in the door, the weight of the door increases.

When the weight of the refrigerator door increases, there is a problem that it takes a lot of effort to open and close the refrigerator door, and problems such as noise or items falling due to impact at the moment when the door is closed may occur.

Additionally, if a device is added to force the door to close, there is a problem that the closing force applied to the door is added, requiring more force when opening the door, and there is a problem that the door may be opened due to the repulsion force at the moment when the door is closed.

Additionally, when a damper is disposed to reduce the closing speed of the door, there is a problem that the damper is exposed to the outside, and there is a problem that additional disposition space has to be secured to dispose the damper.

SUMMARY

An object of the present disclosure is to provide a refrigerator with improved outer appearance by minimizing external exposure of the door damping structure.

An object of the present disclosure is to provide a refrigerator in which a structure for door damping can be efficiently disposed.

An object of the present disclosure is to provide a door damping structure using a detection device that detects the opening and closing of the door.

A refrigerator according to an embodiment of the present disclosure includes a cabinet which has a storage space; a door which opens and closes the storage space; a detection device which is provided in the cabinet and detects the closing of the door; and a damping device which is provided on the door and reduces the closing speed of the door, in which the damping device may be disposed at a position corresponding to the detection device and may be in contact with the detection device when the door is closed.

The damping device may include a magnet, and the detection device may include a detection sensor which detects the magnet.

The damping device may be provided inside the door, and the magnet may form a portion of an outer surface of the damping device.

The damping device may include a cylinder which forms a compressed space in which oil is accommodated and has an open surface; a push member which is provided on the cylinder; a rod which extends from the inside of the cylinder; a piston which is coupled to the rod, moves relative to the compressed space, and forms an orifice through which the oil passes; and a spring which is accommodated in the compressed space and providing elastic force to the piston, and in which one open surface of the cylinder may be shielded by the magnet, and the rod may penetrate the magnet.

The rod may penetrate the door and protrudes to the outside, and the magnet may be in contact with the inner surface of the door.

The rod may be in contact with the detection device when the door is closed.

A plurality of damping parts may be formed in the extending direction at one open end of the cylinder, each of the plurality of damping parts may be formed to have a larger inner diameter as the distance from the opening increases, and the damping force may gradually become smaller as the piston is retracted.

The damping force that reduces the rotational speed of the door may be applied to a damping part closest to the opening among the plurality of damping parts, and the piston may become a low-speed state as the piston is further retracted and passes through another damping part.

The rear surface of the door may be formed by a door liner, a door dike may be formed on the door liner which is adjacent to the inner surface of the storage space when the door is closed, and the damping device may be provided inside the door dike.

The door may be provided with a storage member, the door dike may be formed with a protruding storage member mounting part so that both sides of the storage member are fixed, and the damping device may be provided in the storage member mounting part.

One end of the damping device may be supported by the storage member mounting part, and the other end thereof may protrude through one side of the door dike to be selectively in contact with the detection device.

A fixing bracket for fixing the damping device may be provided on the inner surface of the door dike, and an insulation material may be formed inside the door while the damping device is mounted on the fixing bracket.

The cabinet may include an outer case which forms the outer appearance; an inner case which forms the storage space and has an opening; and an insulating material which is filled between the outer case and the inner case, and the detection device may be mounted inside the cabinet and exposed to the storage space through the opening.

The detection device may include a detection sensor; and a sensor case which accommodates the detection sensor, and the sensor case may include an exposed part that shields the opening and is exposed to the storage space.

The exposed part may form the same plane as the wall of the storage space and may be in contact with the damping device.

A hinge rotatably coupled to the door may be provided on the upper surface of the cabinet, and the detection device may be provided on one side of the hinge.

The hinge may include a hinged cover forming the outer appearance, and the detection device may be exposed to the front surface of the hinge cover.

The damping device may be provided at the rear surface of the door facing the hinge, and at least a portion of the damping device may extend through a rear surface of the door toward the detection device.

A cap decoration may be formed on the upper part of the door, which forms the upper surface of the door and is coupled to the hinge, and the damping device may be mounted inside the cap decoration.

The damping device may include a push member extending rearwardly through the cap decoration, and the push member may be in contact with the detection device and retracted when the door is closed.

The refrigerator according to an embodiment of the present disclosure has the following effects.

According to the present embodiment, the damping device is configured with a detection device for detecting the opening and closing of the door, which has the effect of improving the outer appearance by minimizing external exposure of the damping device itself while realizing soft closing of the door.

In addition, the damping device is disposed inside the door to prevent external exposure thereof, thereby improving the outer appearance, and has the advantage of enabling efficient spatial disposition as it does not require additional installation space.

In addition, the damping device is integrated with a detection device for detecting the opening and closing of the door, thereby improving productivity, and reducing manufacturing costs.

In addition, there is an advantage that the damping device can prevent noise and shaking of stored items by alleviating the impact when the door is closed even in a state where external exposure is minimized.

DETAILED DESCRIPTION OF THE EMBODIMENTS

Hereinafter, specific embodiments of the present disclosure will be described in detail along with the drawings. However, the present disclosure cannot be said to be limited to the embodiments in which the idea of the present disclosure is presented, and other disclosures that are regressive or other embodiments included within the scope of the present disclosure can be easily suggested by adding, changing, or deleting other components.

Before explaining the embodiments, various directions are defined. In an embodiment of the present disclosure, the direction in which a front surface of the door illustrated in FIG. 1 faces may be referred to as a front direction, the direction toward the cabinet based on the front surface of the door may be referred to as a rear direction, the direction toward the floor where the refrigerator is installed may be referred to as a lower direction, and the direction away from the floor may be referred to as an upper direction. In addition, when indicating a previously undefined direction, the direction can be defined and explained based on each drawing.

Figure 1:
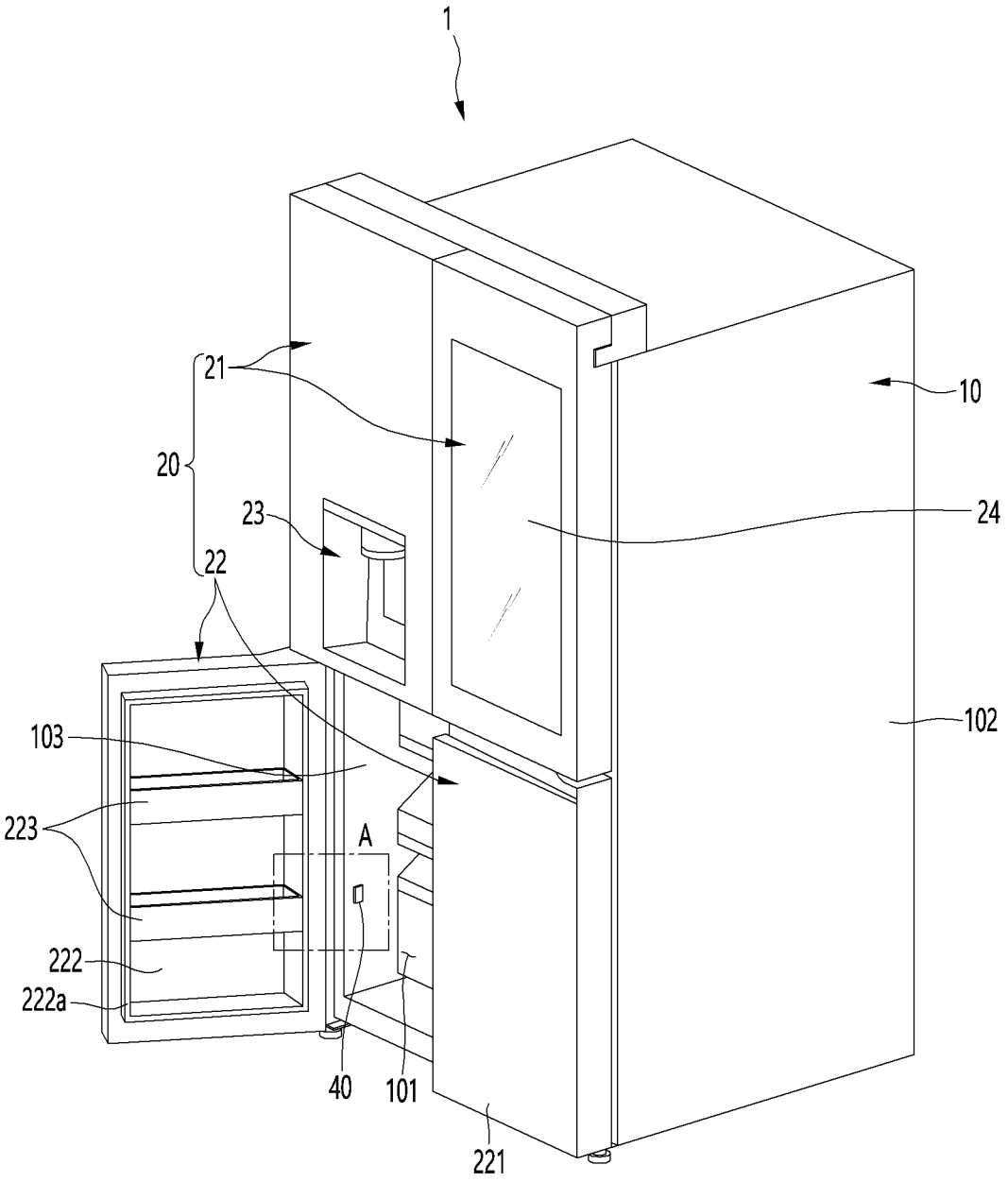
FIG. 1 is a perspective view illustrating a refrigerator according to an embodiment of the present disclosure.
Figure 2:
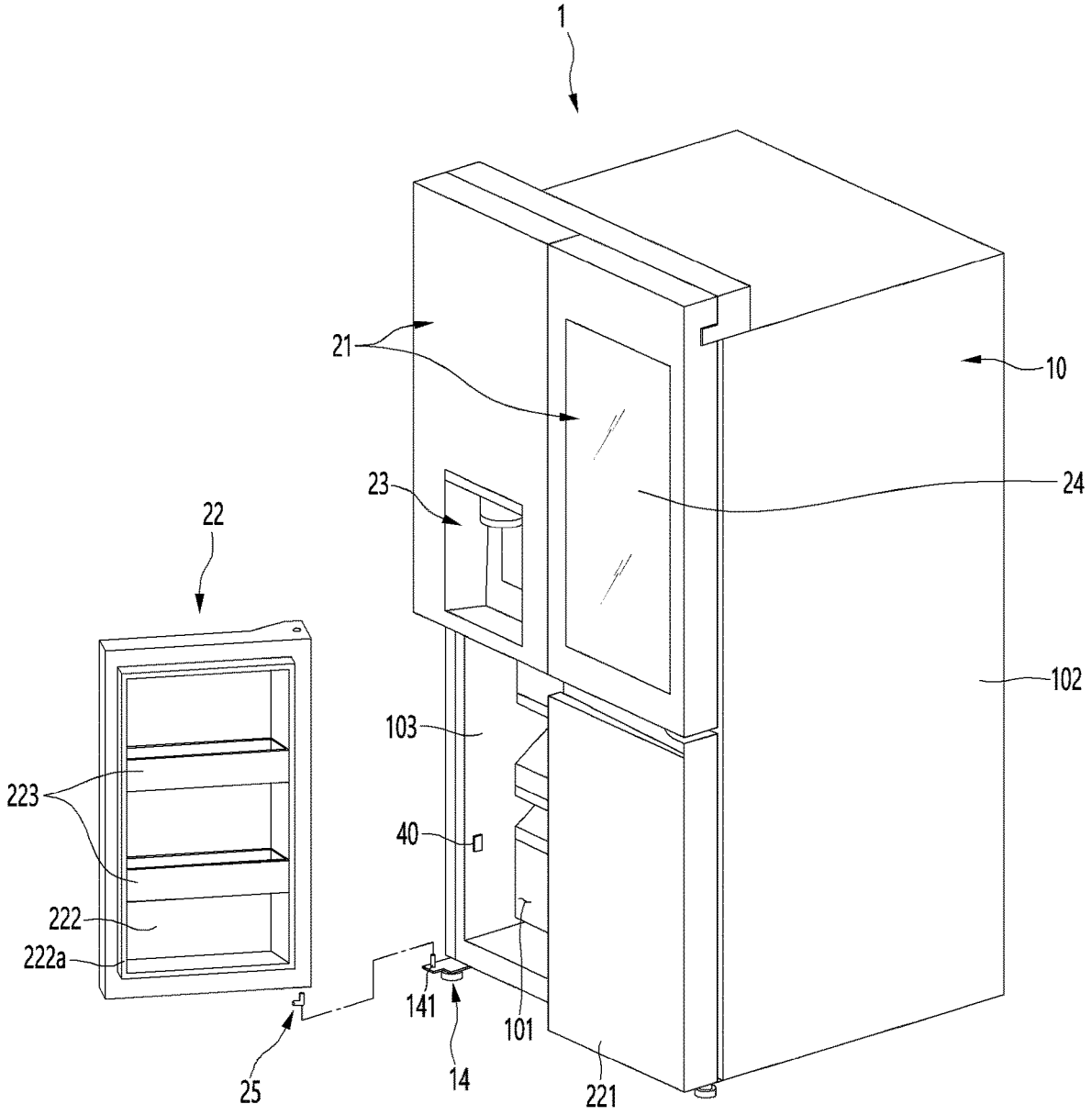
FIG. 2 is an exploded perspective view illustrating a state where the door of the refrigerator is disassembled.

FIG. 1 is a perspective view illustrating a refrigerator according to an embodiment of the present disclosure, and FIG. 2 is an exploded perspective view illustrating a state where the door of the refrigerator is disassembled.

As illustrated in the drawing, the overall outer appearance of the refrigerator 1 according to an embodiment of the present disclosure may be formed by a cabinet 10 that forms a storage space 101 with an open front surface, and a door that opens and closes the storage space 101.

The cabinet 10 may include a storage space 101 with an open front surface. The inside of the cabinet may be composed of an upper storage space and a lower storage space divided up and down. For example, the upper storage space may be a refrigerating chamber and the lower storage space may be a freezing chamber.

A door 20 may be provided in front of the cabinet 10. The door 20 may be provided with a panel 221 that forms an outer appearance on the front. The panel 221 may be formed of various materials such as glass, metal, ceramic, and plastic. In addition, the door 20 may be equipped with a dispenser 23 that can take out water or ice from the outside, and a transparent panel assembly 24 that can see through the inside may be disposed.

There may be a plurality of doors 20, and each door 20 may be configured to independently open and close the storage space 101 by rotating it. For example, the door 20 may include an upper door 21 that opens and closes the upper storage space, and a lower door 22 that opens and closes the lower storage space.

The door 20 may be configured in various ways according to the disposition of the storage space. In the present embodiment, an example provided with four doors 20 will be described, but it should be noted in advance that the present disclosure may be applicable to all refrigerators equipped with at least one rotating door 20.

The upper end and the lower end of the upper door 21 and the lower door 22 may be rotatably coupled to each other by a hinge. In addition, a pair of upper doors 21 and a pair of lower doors 22 may be disposed side by side on both left and right sides.

For example, the lower door 22 may be coupled to a hinge mounted on the cabinet 10. At this time, the hinge pin 141 of the hinge 14 may be inserted into the lower surface of the door 20 and axially coupled. Additionally, the door 20 may be equipped with an auto-closing device 25.

The auto-closing device 25 can be inserted through an opening in the lower surface of the door 20. The auto-closing device 25 can automatically close the door 20 by adding force in the closing direction of the door 20. The auto-closing device 25 may be located on the same extension line as the rotation center of the door 20 and may be combined with the hinge 14 to serve as the rotation shaft of the door 20.

As an example, the auto-closing device 25 may include a case. The case can accommodate a spring therein. A shaft coupling part is provided on the lower surface of the case, and the shaft coupling part may be connected to the spring. The shaft coupling part may be coupled to the hinge pin 141 when the door 20 is mounted and may be rotated together when the door 20 rotates.

The spring is formed as a coil spring structure and may be directly or indirectly connected to the shaft coupling part. Accordingly, the spring may be compressed or tensioned when the shaft coupling part rotates. The spring may act when the door 20 is at a set angle or less to provide elastic force so that the door 20 can be completely closed. Additionally, the auto-closing device 25 may prevent elastic force from being applied in the direction in which the door 20 is rotated to open.

The auto-closing device 25 is only one embodiment of the present disclosure, and various other structures provided on the door 20 or the hinge 14 may be possible to automatically close the door 20.

Figure 3:
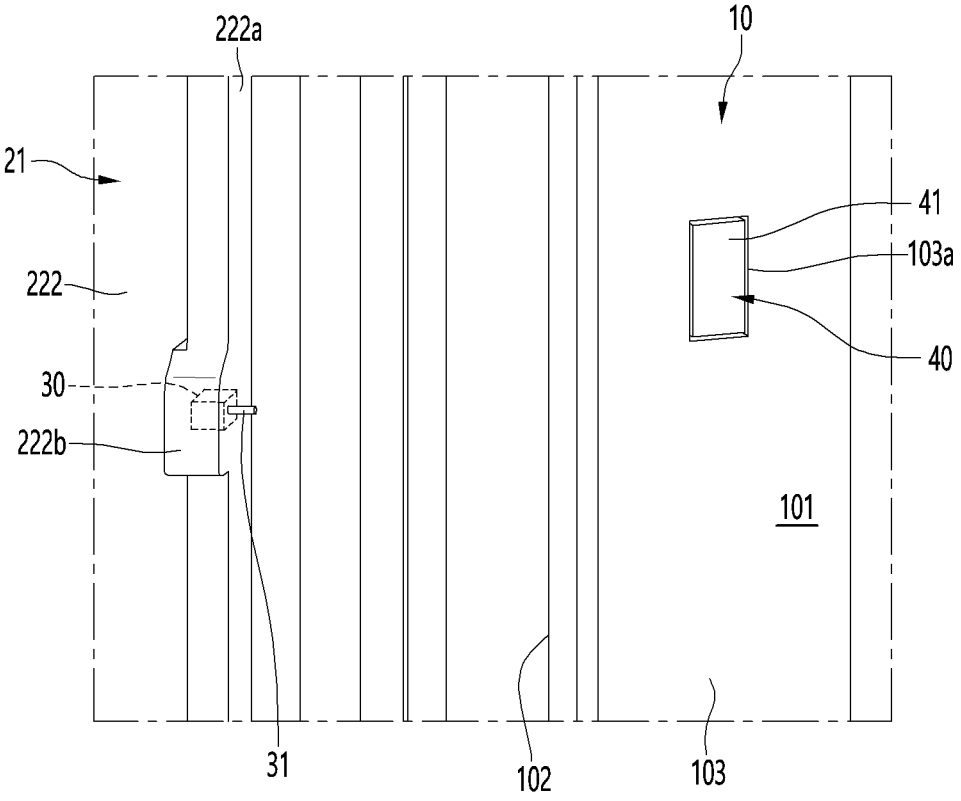
FIG. 3 is an enlarged view illustrating portion A of FIG. 1.
Figure 4:
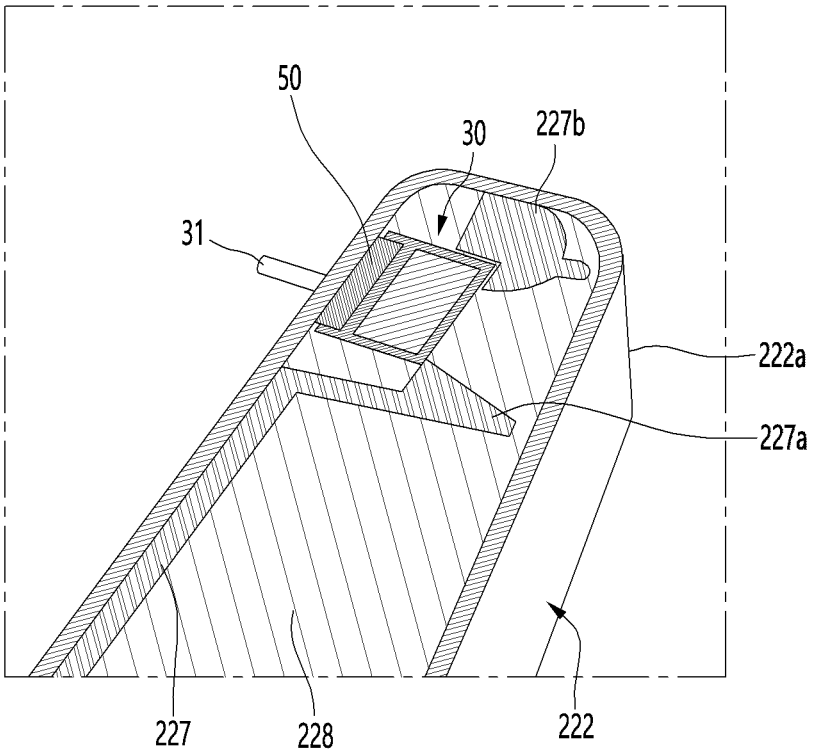
FIG. 4 is a cross-sectional view illustrating the disposition of the damping device.
Figure 5:
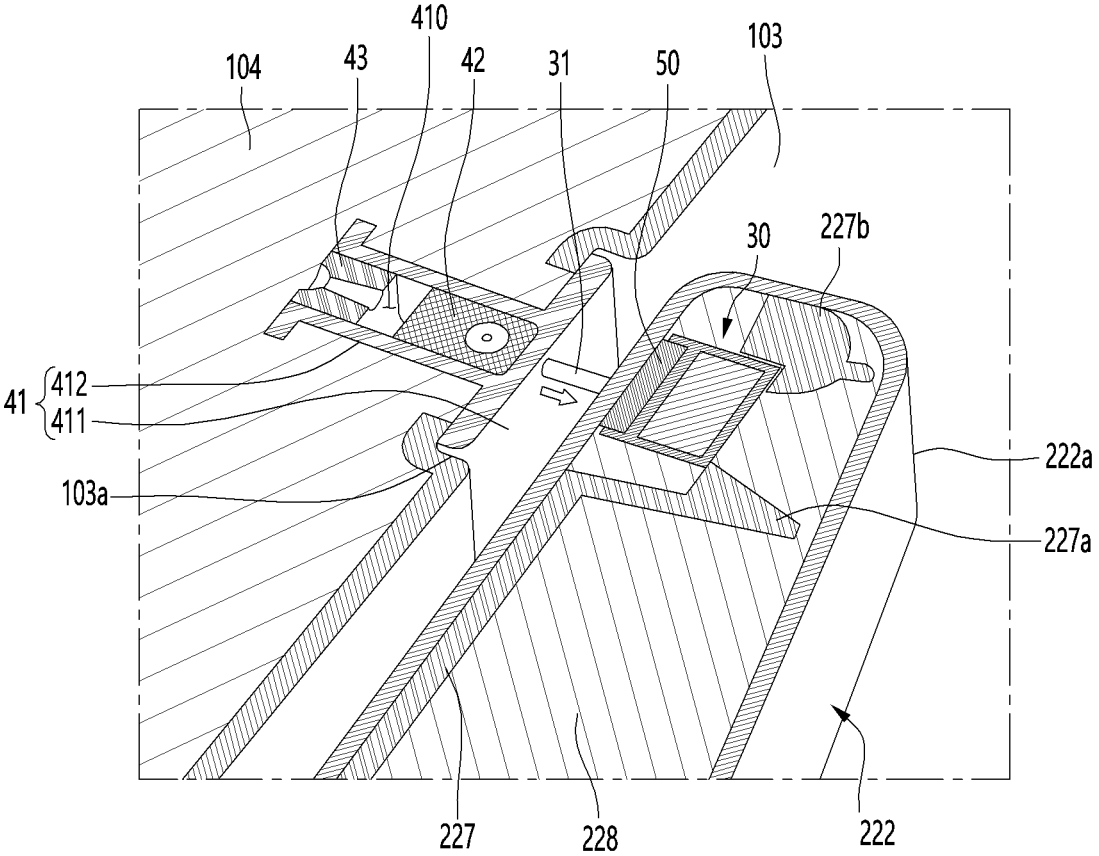
FIG. 5 is a cross-sectional view illustrating the state of the damping device and the detection device when the door of the refrigerator is closed.

FIG. 3 is an enlarged view illustrating portion A of FIG. 1, FIG. 4 is a cross-sectional view illustrating the disposition of the damping device, and FIG. 5 is a cross-sectional view illustrating the state of the damping device and the detection device when the door of the refrigerator is closed.

As illustrated, the cabinet 10 may include an outer case 102 that forms an outer surface, and an inner case 103 that is spaced apart from the outer case 102 and forms the storage space. Additionally, an insulating material 104 may be filled between the outer case 102 and the inner case 103.

In addition, the door 20 may include a panel 221 that forms the front surface, a door liner 222 that is disposed behind the panel 221 and forms the rear surface of the door 20, and an insulating material 228 filled in the inside of the door 20.

Meanwhile, the door liner 222 may have a door dike 222*a* protruding rearward along the circumference. The door dike 222*a* may be referred to as a door protrusion and a liner protrusion. Additionally, a storage member mounting part 222*b* may be formed on the inner surface of the door dike 222*a*, and the door storage member 223 may be mounted on the storage member mounting part 222*b*. For example, the storage member 223 may be formed in a basket shape.

The door dike 222*a* protrudes inward, is inserted into the storage space 101 when the door 20 is closed, and may be adjacent to the inner case 103. In other words, as illustrated in FIG. 5, at least a portion of the outer surface of the door dike 222*a* may be disposed parallel to the inner case 103.

Meanwhile, a damping device 30 may be provided inside the door dike 222*a*. The damping device 30 may be configured as an oil damper, for example. The damping device 30 may be disposed on the storage member mounting part 222*b* of the door dike 222*a*.

The storage member mounting part 222*b* has a protruding structure for mounting the storage member 223 and is thicker than other portions of the door dike 222*a*, thereby being capable of providing sufficient space for the damping device 30 to be mounted.

In addition, the remaining portion of the damping device 30 except for the rod 31 is disposed on the inside of the door 20 and embedded in the insulation material 228, and only the rod 31 may penetrate the door liner 222 and protrude outward. At this time, the rod 31 may protrude perpendicularly to the door liner 222, and may protrude towards the inner surface of the storage space 101, that is, both sides of the inner case 103, when the door 20 is closed. Additionally, the protruding distance of the rod 31 may be at least longer than the distance between the outer surface of the door dike 222*a* and the inner case 103 when the door 20 is closed.

In addition, a fixing bracket 227 for fixing the damping device 30 may be further provided inside the door 20. The fixing bracket 227 is disposed along the inner surface of the door dike 222*a* and may be made of a plastic material.

The fixing bracket 227 may have an accommodation space and hooks 227*a* and 227*b* formed on one side. The accommodation space may be formed to a corresponding size so that the damping device 30 can be accommodated. In addition, the hooks 227*a* and 227*b* can fix the outer surface of the damping device 30 by engaging them. In addition, the remaining portion of the fixing bracket 227 is formed in close contact with the inner surface of the door dike 222*a*. In particular, the fixing bracket 227 may extend to the protruding end portion of the door dike 222*a*.

Therefore, when the fixing bracket 227 is mounted, the shape of the door dike 222*a* can be maintained, and the damping device 30 can be disposed at an accurate position. In addition, even if the foaming liquid is injected into the inside of the door 20 to form the insulation material 228, the damping device 30 may be configured not to deviate from the designated position thereof.

In addition, in a state where the insulating material 228 is formed, the damping device 30 has a structure embedded by the insulating material 228, and therefore, even with the impact caused by repeated opening and closing of the door 20 and repeated pressurization of the damping device 30, the damping device 30 can maintain the fixed mounting position thereof.

Additionally, a magnet 50 may be disposed on one surface of the damping device 30. The magnet 50 is disposed on the damping device 30 and may form the outer surface of the damping device 30. Additionally, the magnet 50 may be in close contact with the door liner 222 when the damping device 30 is installed. In addition, the magnet 50 may be located in a position facing the detection device 40. In addition, the magnet 50 can be penetrated by the rod 31. The magnet 50 may be provided as a separate component from the damping device 30 and disposed between the damping device 30 and the door liner 222.

Meanwhile, the detection device 40 may be provided on the wall of the cabinet 10 facing the damping device 30. The detection device 40 is used to detect the closing of the door 20 and may be provided inside the cabinet 10.

In detail, the detection device 40 may be provided at a position facing the damping device 30 when the door 20 is closed. The detection device 40 is disposed on the left and right walls of the storage space 101 and may be exposed through the opening 103*a* of the inner case 103.

As an example, the detection device 40 may include a sensor case 41 fixedly mounted on the inner case 103 and a detection sensor 42 mounted on the sensor case 41.

The sensor case 41 may include an exposed part 411 exposed to the inside of the storage space 101 by shielding the opening 103*a*, and a case body 412 that protrudes from the rear surface the exposed part 411 to accommodate the detection sensor 42.

The exposed part 411 is formed in a planar shape and may form the same plane as the inner surface of the inner case 103. Additionally, the exposed part 411 may be formed at a position in contact with the rod 31 when the door 20 is closed. Additionally, the exposed part 411 may be formed at a position facing the magnet 50 when the door 20 is closed. In addition, the exposed part 411 may be formed larger than the size of the magnet 50.

The case body 412 may extend outside the inner case 103 through the opening. In addition, an accommodation space that opens outward may be formed in the case body 412. The accommodation space 410 may be formed to a size into which the detection sensor 42 is inserted. The detection sensor 42 may be in close contact with the exposed part 411 inside the accommodation space. The detection sensor 42 may be a sensor that detects a magnet, magnetic force, or magnetic field, or may be another device capable of detecting the magnet 50.

The open rear surface of the accommodation space 410 may be shielded by the cap 43. Therefore, when the insulation material 104 is formed inside the cabinet 10, the foaming liquid can be prevented from penetrating into the detection sensor 42.

A hook-like locking part is formed on one side of the case body 412 to allow the sensor case 41 to be fixed to the inner case 103.

Figure 6:
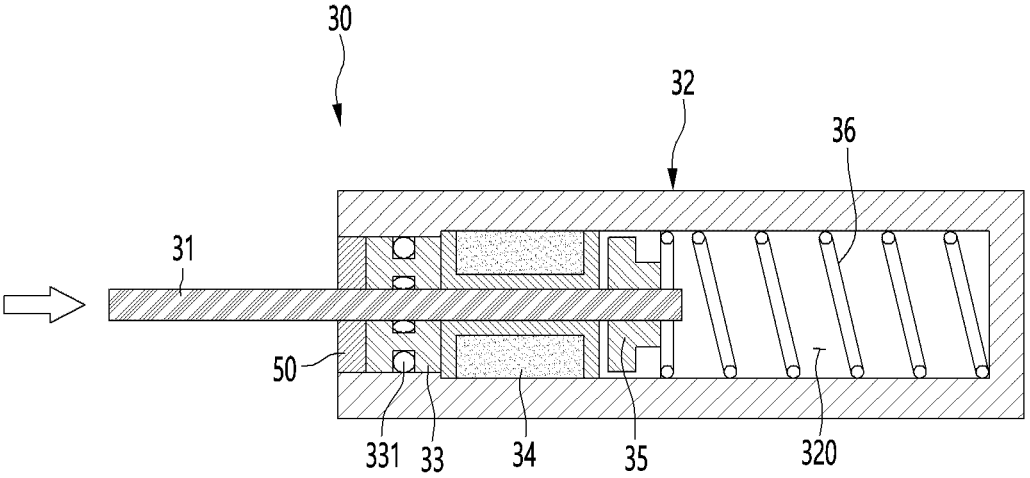
FIG. 6 is a cross-sectional view illustrating the damping device.

FIG. 6 is a cross-sectional view illustrating the damping device.

As illustrated, the damping device 30 may include the cylinder 32, the rod 31, the piston 35, and the spring 36.

The cylinder 32 has one side open and may form a buffer space 320 in which oil is accommodated.

One open surface of the cylinder 32 may be shielded by a sealing member 33. An O-ring 331 may be provided around the sealing member 33. Additionally, the magnet 50 may be provided on the outer surface of the sealing member 33. The magnet 50 may be exposed to the outside.

The rod 31 may be inserted into the buffer space 320 from the outside of the cylinder 32 by penetrating the magnet 50 and the scaling member 33.

Accordingly, the magnet 50 can not only shield the opening of the cylinder 32 but also form a portion of the outer surface of the damping device 30. Of course, within the range in which the magnet 50 can be detected through the detection device 40, the magnet 50 may be disposed further inside the cylinder 32 than the sealing member 33.

A sponge 34 may be further provided inside the cylinder 32. The sponge 34 may be provided between the piston 35 and the sealing member 33. The sponge 34 is compressed so that the oil passing through the orifice of the piston 35 can be moved when the piston 35 is advanced, thereby compensating for the volume for movement of the oil.

The piston 35 may be supported by the spring 36 within the buffer space 320. One end of the spring 36 may be in contact with the piston 35 and the other end thereof may be in contact with one end of the cylinder 32.

Additionally, an orifice through which oil moves within the buffer space 320 may be formed in the piston 35. The piston 35 is connected to the rod 31 and can relatively move together with the rod 31 within the buffer space 320.

Meanwhile, when the door 20 is closed, the rod 31 may come into contact with the exposed part of the detection device 40. When the rod 31 moves, the magnet 50, the scaling member 33, and the sponge 34 can remain fixed inside the cylinder 32. Additionally, the piston 35 moves together with the rod 31 and can pressurize the spring 36 and oil.

At this time, the piston 35 may relatively move to the right (as seen in FIG. 6) within the buffer space 320. In addition, the oil in the buffer space 320 moves through the orifice to the space on the left side where the sponge 34 is disposed. The oil in the buffer space 320 flows at a constant flow rate along the orifice, thereby providing constant oil resistance. Accordingly, the rod 31 moves at a constant speed inside the cylinder 32, and thus the door 20 is decelerated and can be closed at a constant speed.

In addition, when the door 20 is closed, the magnet 50 faces the detection device 40 at the closest position. In addition, the detection sensor 42 detects the magnet 50 to detect the closing of the door 20.

In other words, smooth closing by deceleration of the door 20 can be ensured by the damping device 30, and at the same time, it can be possible to detect the closing of the door 20 by the magnet 50.

Meanwhile, the present disclosure may be possible in various other embodiments in addition to the above-described embodiments. Another embodiment of the present disclosure is characterized by providing a damping device that provides different damping forces at multiple stages. Other embodiments of the present disclosure have the same structure except for some structures of the damping device, and the same structures will be described using the same names and symbols, and detailed descriptions thereof will be omitted.

Figure 7:
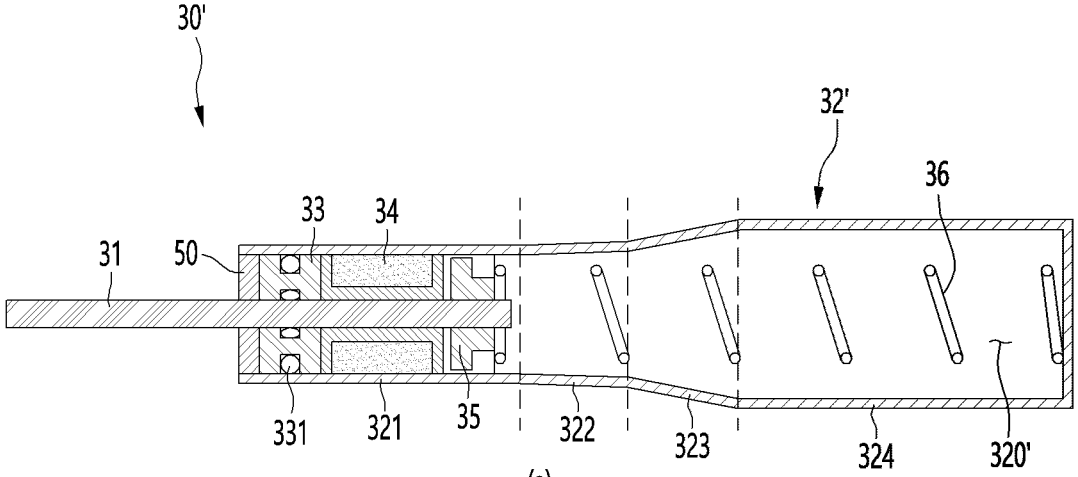
FIG. 7 is a cross-sectional view illustrating a damping device according to another embodiment of the present disclosure.
Figure 7:
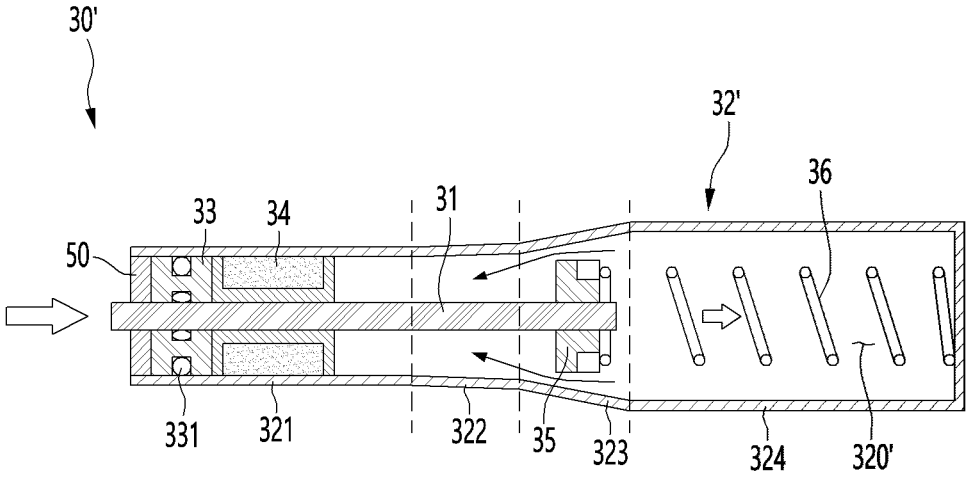

FIG. 7 is a cross-sectional view illustrating a damping device according to another embodiment of the present disclosure.

In FIG. 7, (a) illustrates a state of the damping device 30' in which no external force is applied to the rod 31. In addition, in FIG. 7, (b) illustrates the state of the damping device 30' in which the rod 31 is maximally retracted due to an external force being applied to the rod 31.

As illustrated, the damping device 30' in another embodiment of the present disclosure may include a cylinder 32', a piston 35, and a rod 31. The cylinder 32 may form a buffer space 320 in which oil is accommodated, and one side may be open. In addition, one open surface may be shielded by a sealing member 33. An O-ring 331 may be provided around the sealing member 33.

Additionally, the magnet 50 may be disposed on the outer surface of the scaling member 33. The magnet 50 may be exposed to the outside of the damping device 30' and may form a portion of the outer surface of the damping device 30'. In addition, the magnet 50 may be located in a position facing the detection device 40.

Additionally, a sponge 34 may be provided in the buffer space 320. The rod 31 penetrates the magnet 50, the sealing member 33, and the sponge 34, and may extend from the inside of the buffer space 320 to the outside. Additionally, a piston 35 that moves together with the rod 31 may be provided at the end portion of the rod 31.

Additionally, the rod 31 may be pressed in contact with the wall of the storage space or the detection device 40 when the door 20 is closed.

The cylinder 32' may include a first part 321. The damping force generated when the piston 35 moves within the first portion may be referred to as a first damping force.

The cylinder 32 may include a second part 322 extending from the first part 321. The inner diameter of the second part 322 may be larger than the inner diameter of the first part 321. The inner diameter of the second part 322 may increase as the distance from the first part 321 increases. In other words, the second part 322 may be inclined with respect to the first part 321. The damping force generated when the piston 35 moves within the second part 322 may be referred to as a second damping force. The second damping force is smaller than the first damping force.

The cylinder 32 may further include a third part 323 extending from the second part 322. The inner diameter of the third part 323 may increase as it moves away from the second part 322. In other words, the third part 323 may be inclined with respect to the second part 322. At this time, the inclination angle of the third part 323 with respect to the first part 321 may be greater than the inclination angle of the second part 322 with respect to the first part 321. The damping force generated when the piston 35 moves within the third portion 323 may be referred to as a third damping force. The third damping force is smaller than the second damping force.

The cylinder 32 may further include a fourth part 324 extending from the third part 323. The inner diameter of the fourth part 324 may be larger than the inner diameter of the third part 323. Alternatively, the inner diameter of the fourth part 324 may be the same as the maximum inner diameter of the third part 323. The inner diameter of the fourth part 324 may be constant in the longitudinal direction or may increase as it moves away from the third part 323. The damping force generated when the piston 35 moves within the fourth portion 324 may be referred to as the fourth damping force. The fourth damping force is smaller than the third damping force.

In the present embodiment, as the inner diameter of the cylinder 32 becomes larger, the amount of oil flowing between the inner circumferential surface of the cylinder 32 and the piston 35 increases, thereby reducing the damping force.

Therefore, in the case of the present embodiment, a damping force is generated in a certain section where the door 20 is closed, and the generated damping force can be gradually reduced.

Meanwhile, a spring 36 supported at both ends between the piston 35 and the cylinder 32 may be further provided inside the buffer space 320'. Therefore, when no external force is provided to the rod 31, the piston 35 may be returned to the state illustrated in (a) of FIG. 7 by the spring 36.

In the present embodiment, the cylinder 32 includes four parts with different inner diameters, but the idea of the present disclosure is to clarify that the cylinder 32 includes two or more parts with different inner diameters.

In controlling the damping force of the damping device 30' in multiple stages, the damping force may be generated in the process of the damping device 30' contacting the wall of the storage space without contacting the detection device 40.

The damping device 30' sequentially provides multiple stages of damping force, thereby gradually reducing the damping force in the process of closing the door 20, allowing the door 20 to close more smoothly. In addition, in the final section where the door 20 is completely closed, the damping force is set to the lowest to ensure that the door 20 can be closed more reliably.

Meanwhile, the present disclosure may be possible in various other embodiments in addition to the above-described embodiments. Another embodiment of the present disclosure is characterized in that the damping device is provided outside the cabinet. Other embodiments of the present disclosure have the same structure except for the disposition positions of the damping device and the detection device, and the same structure will be described using the same name and symbol, and the detailed description will be omitted.

Figure 8:
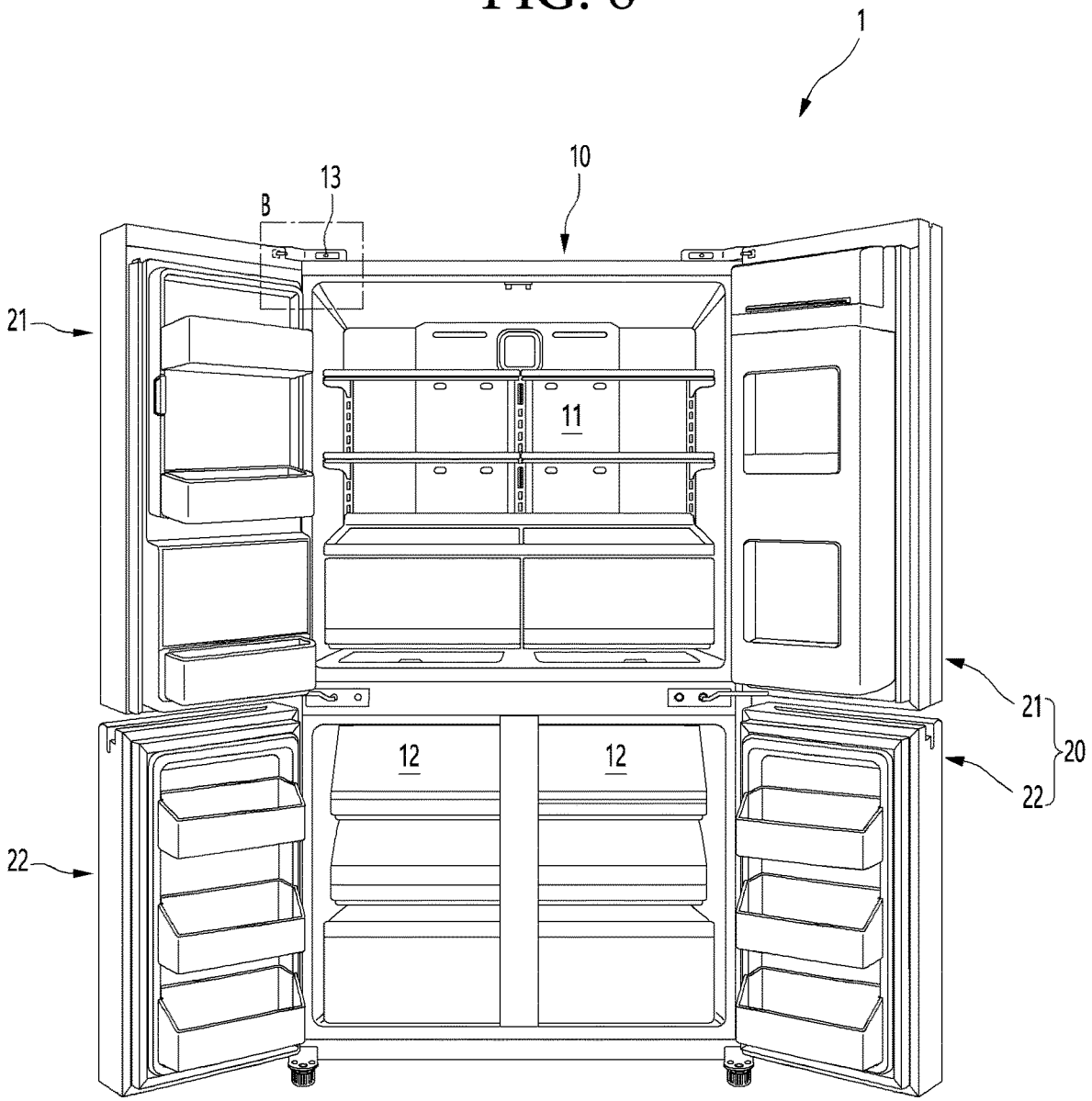
FIG. 8 is a view illustrating a state where a refrigerator door is opened according to another embodiment of the present disclosure.
Figure 9:
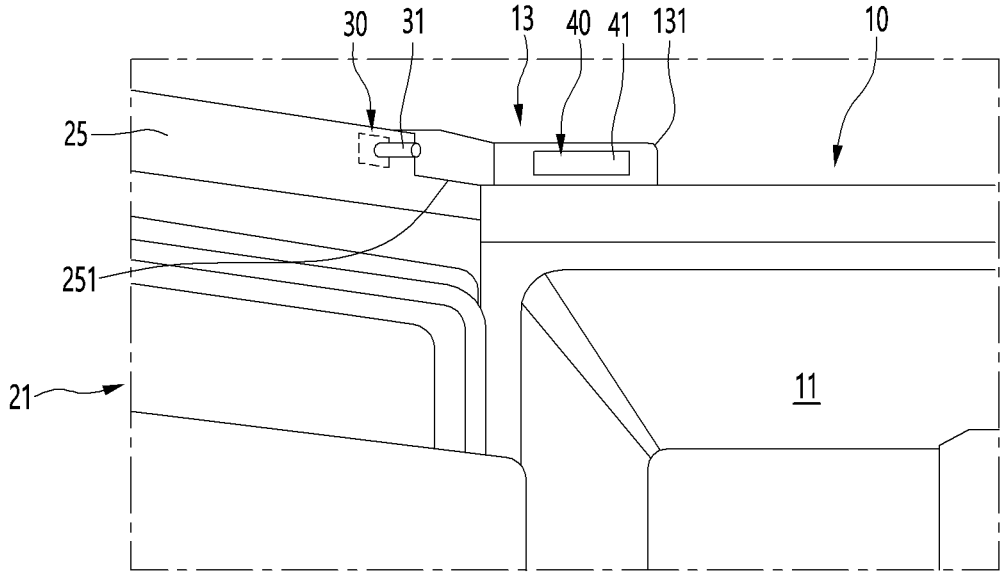
FIG. 9 is an enlarged view illustrating portion B of FIG. 8.
Figure 10:
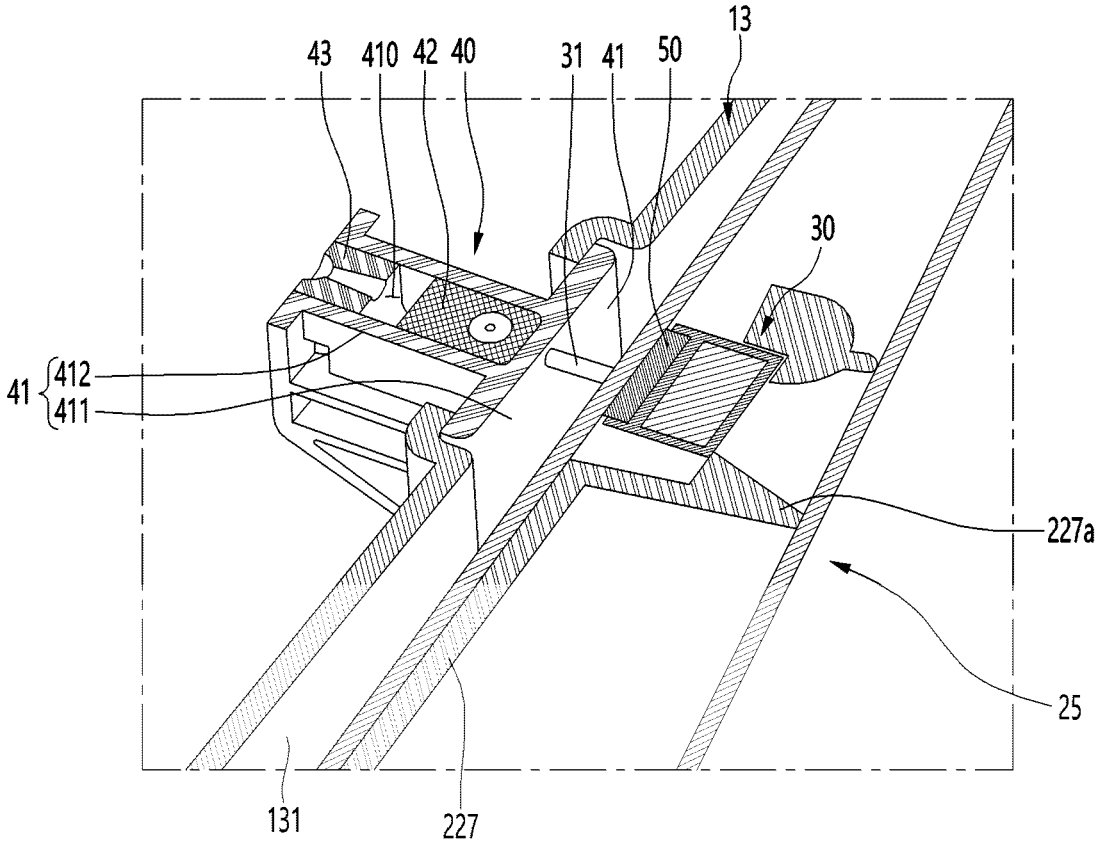
FIG. 10 is a cross-sectional view illustrating the states of the damping device and the detection device when the door of the refrigerator is closed.

FIG. 8 is a view illustrating a state where a refrigerator door is opened according to another embodiment of the present disclosure, FIG. 9 is an enlarged view illustrating portion B of FIG. 8, and FIG. 10 is a cross-sectional view illustrating the states of the damping device and the detection device when the door of the refrigerator is closed.

As illustrated, the overall outer appearance of the refrigerator 1 according to another embodiment of the present disclosure may be formed by a cabinet 10 forming a storage space with an open front surface, and a door 20 opening and closing the storage space.

The cabinet 10 may include a storage space with an open front surface. The inside of the cabinet may be composed of an upper storage space 11 and a lower storage space 12 divided up and down. For example, the upper storage space may be a refrigerating chamber and the lower storage space may be a freezing chamber.

There may be a plurality of doors 20, and each door 20 may be configured to independently open and close the storage space by rotating the door. As an example, the door may include an upper door 21 that opens and closes the upper storage space 11 and a lower door that opens and closes the lower storage space 12.

The door 20 may be configured in various ways according to the disposition of the storage space. In the present embodiment, an example provided with four doors will be described, but it should be noted in advance that the present disclosure is applicable to all refrigerators equipped with at least one rotating door 20.

The upper end and the lower end of the upper door 21 and lower door 22 may be rotatably coupled to each other by a hinge. Additionally, a pair of the upper door and the lower door may be disposed side by side on both left and right sides.

As an example, the upper door 21 may be combined with a hinge 13 mounted on the cabinet 10. Additionally, the hinge 13 may include a hinge cover 131.

As an example, the hinge 13 may include a hinge plate and a hinge cover 131 that shields the hinge plate.

The hinge plate is coupled to the cabinet 10 and may be made of a metal material. In addition, the hinge plate may extend toward the door 20. A hinge pin is provided at the front end of the hinge plate, and the hinge pin may be axially coupled to the upper surface of the door 20.

The hinge cover 131 may be mounted on the upper surface of the cabinet 10 and may accommodate the hinge plate therein to shield the hinge plate. At least a portion of the hinge cover 131 may protrude toward the upper surface of the upper door 21. Additionally, the hinge cover 131 protrudes upward from the upper surface of the cabinet 10 and may be disposed to face the upper end of the upper surface of the door 20.

Additionally, a detection device 40 may be provided on the front surface of the hinge cover 131. The detection device 40 may be provided inside the hinge cover 131, and the exposed part 411 may be exposed to the front surface of the hinge cover 131. Since the specific structure of the detection device 40 is the same as the above-described embodiment, detailed description thereof will be omitted. However, since the detection device 40 is provided outside the cabinet 10, the detection device can be located in a location that is not affected by the insulation material.

Additionally, a damping device 30 may be provided at the rear surface of the upper door 21 facing the detection device 40. The damping device 30 is provided inside the upper door 21, and the rod 31 may protrude through the rear surface of the door 20. The damping device 30 may be located in a position facing the detection device 40 in the front and rear direction when the upper door 21 is closed.

Since the specific structure of the damping device 30 is the same as the above-described embodiment, detailed description thereof will be omitted.

The damping device 30 may be formed on the upper cap decoration 25 that forms the upper portion including the upper surface of the upper door 21. Accordingly, the damping device 30 may not be affected by the insulation material disposed inside the upper door 21.

In addition, the rod 31 may be formed in any length which protrudes backward through the rear surface of the upper door 21, but may be in contact with the exposed part 411 of the detection device 40 when the upper door 21 is closed. In other words, the rod 31 may be formed to be longer than the distance between the rear surface of the door cap decoration 25 and the front surface of the hinge cover 131.

Meanwhile, the detection device 40 may be formed on one side of the front surface of the cabinet 10, and the damping device 30 may also be provided on one side of the door 20 facing the detection device 40 when the door 20 is closed.

In addition to a structure for detecting the magnet 50, the detection device 40 may also have a switch or sensor structure for directly detecting contact with the damping device 30.

What is claimed is:

1. A refrigerator comprising:

a cabinet having a storage space;

a door configured to open and close the storage space;

a detector located in the cabinet, the detector being configured to detect closing of the door; and a damper located on the door, the damper being configured to reduce a closing speed of the door, the damper being located at a position corresponding to the detector and in contact with the detector when the door is closed, wherein the door includes:

a door liner defining a rear surface of the door; and a door dike located at the door liner, the door dike being adjacent to an inner surface of the storage space when the door is closed, and wherein the damper is located in the door dike.

2. The refrigerator of claim 1, wherein the damper includes a magnet, and wherein the detector includes a detection sensor configured to detect the magnet.

3. The refrigerator of claim 2, wherein the damper is located inside the door, and wherein the magnet defines a portion of an outer surface of the damper.

4. The refrigerator of claim 3, wherein the damper further includes:

a cylinder having a space to accommodate oil therein, the cylinder having a first end and a second end, the first end having an opening;

a push member extending from inside of the cylinder;

a piston coupled to the push member, the piston being configured to move within the space and to permit the oil to move therepast; and a spring located in the space, the spring being configured to provide an elastic force to the piston, and wherein the magnet closes the first end of the cylinder, the magnet having a hole through which the push member extends.

5. The refrigerator of claim 4, wherein the push member is configured to protrude outside the door, and wherein the magnet is in contact with an inner surface of the door.

6. The refrigerator of claim 5, wherein the push member contacts the detector when the door is closed.

7. The refrigerator of claim 4, wherein the cylinder includes a plurality of damping regions between the first end of the cylinder and the second end of the cylinder, and wherein, when the piston moves away from the first end toward the second end through the plurality of damping regions, a damping force generated by the piston decreases as the piston passes through the plurality of damping regions.

8. The refrigerator of claim 7, wherein at least one damping region of the plurality of damping regions has a gradually increasing diameter relative to another damping region of the plurality of damping regions located between the at least one damping region and the first end of the cylinder.

9. The refrigerator of claim 7, wherein the damping force provided in one damping region of the plurality of damping regions that is closest to the first end reduces a rotational speed of the door as the door is closed.

10. The refrigerator of claim 1, wherein the door further include a storage member, wherein the door dike includes a pair of protruding storage member mounting parts to support opposite sides of the storage member, and wherein the damper is provided in one of the storage member mounting parts.

11. The refrigerator of claim 10, wherein a first end of the damper is supported by the one of the storage member mounting parts, and wherein a second end of the damper is configured to move relative to the door dike to be in contact with the detector when the door is closed.

12. The refrigerator of claim 1, wherein the door further includes:

a fixing bracket configured to support the damper, the fixing bracket being located at an inner surface of the door dike; and an insulating material inside the door, the insulating material surrounding a portion of the damper.

13. The refrigerator of claim 1, wherein the cabinet further includes:

an outer case defining an outer appearance of the cabinet;

an inner case defining the storage space, the inner case having an opening; and an insulating material filled between the outer case and the inner case, and wherein at least a portion of the detector is located between the outer case and the inner case, the detector being exposed to the storage space through the opening of the inner case.

14. The refrigerator of claim 13, wherein the detector includes:

a detection sensor; and a sensor case accommodating the detection sensor therein, the sensor case including an exposed part configured to close the opening of the inner case.

15. The refrigerator of claim 14, wherein the damper is configured to contact the exposed part when the door is closed.

16. A refrigerator comprising:

a cabinet having a storage space;

a door configured to open and close the storage space;

a hinge rotatably supporting the door, the hinge being located at an upper surface of the cabinet, a detector located at one side of the hinge, the detector being configured to detect closing of the door; and a damper located on the door, the damper being configured to reduce a closing speed of the door, the damper being located at a position corresponding to the detector and in contact with the detector when the door is closed, wherein the damper is located at a rear surface of the door facing the hinge, and wherein at least a portion of the damper extends through the rear surface of the door toward the detector.

17. The refrigerator of claim 16, wherein the hinge includes a hinge cover defining an outer appearance of the hinge, and wherein the detector is exposed at a front surface of the hinge cover.

18. The refrigerator of claim 16, wherein the door includes a cap decoration defining an upper part of the door, the cap decoration being coupled to the hinge, and wherein the damper includes a push member extending rearwardly through the cap decoration, the push member being in contact with the detector and retracted when the door is closed.

* * * * *